US007207892B2

(12) United States Patent
Chang

(10) Patent No.: US 7,207,892 B2
(45) Date of Patent: Apr. 24, 2007

(54) HANDLE SECTION COMBINATION FOR BILLIARD CUE

(76) Inventor: Jung-Shih Chang, No. 32, Lane 25, Li Min Street, Ta Li City, Taichung Hsien (TW)

( * ) Notice: Subject to any disclaimer, the term of this patent is extended or adjusted under 35 U.S.C. 154(b) by 0 days.

(21) Appl. No.: 11/226,206

(22) Filed: Sep. 15, 2005

(65) Prior Publication Data

US 2007/0060407 A1 Mar. 15, 2007

(51) Int. Cl.
*A63D 15/08* (2006.01)
*A63B 53/14* (2006.01)

(52) U.S. Cl. ..... 473/44; 473/301

(58) Field of Classification Search ..... 473/300–303, 473/568, 44–49, 549–551
See application file for complete search history.

(56) References Cited

U.S. PATENT DOCUMENTS 1,139,843 A * 5/1915 Brown ..... 473/302
1,943,399 A * 1/1934 Smith ..... 473/302
2,877,018 A * 3/1959 Turner ..... 473/203
3,198,520 A * 8/1965 Ahmuty ..... 473/203
3,311,375 A * 3/1967 Onions ..... 473/301
5,478,074 A * 12/1995 Storper ..... 473/299
6,449,803 B1 * 9/2002 McConchie ..... 16/431
2003/0139223 A1 * 7/2003 Ulrich et al. ..... 473/301
2003/0166419 A1 * 9/2003 Gulyassy ..... 473/44

* cited by examiner

*Primary Examiner*—Mark S. Graham
(74) *Attorney, Agent, or Firm*—Browdy and Neimark, P.L.L.C.

(57) ABSTRACT

A handle section combination for a billiard cue, which includes a handle section, an elongated strip and at least a binding ring. The handle section has an adjoining end to adjoin to the other section of the billiard cue. The strip is made of resilient materials and wrapped about the surface of the handle section. The strip has a front end with a first inserting portion. The binding ring is made of rigid materials and has an inner surface with a first receiving portion. The binding ring is put around the adjoining end of the handle section in such a way that the first inserting portion of the strip can be received tightly in the first receiving portion of the binding ring when the strip is wrapped about the handle section.

6 Claims, 2 Drawing Sheets

HANDLE SECTION COMBINATION FOR BILLIARD CUE

BACKGROUND OF THE INVENTION

1. Field of the Invention

The present invention relates to billiard cues, and more particularly, to a handle section combination for a billiard cue.

2. Description of the Related Art

The conventional billiard cue having a better quality generally includes a handle section spirally wrapped with a strip made of leather materials or the like to have a comfortable and stable gripping. The strip for such a prior art handle section combination often has a front and rear ends respectively applied a conventional doubled-sided adhesive tape thereover. When the protective ribbon of the adhesive tape is removed, the ends of the strip each forms an adhesive layer such that the end can be adhered respectively to the surface of the handle section.

A problem with this prior art combination is that the ends of the strip will easily be separated from the handle section due to the degraded adhesion of the adhesive layer caused by humidity as well as hand perspiration of the user of the billiard cue.

A further disadvantage of the prior art combination is that the strip can not evenly be wrapped about the whole surface of the handle section for having not a specified place provided on the surface of the handle section to be adhered by the ends of the strip.

SUMMARY OF THE INVENTION

It is therefore an object of the present invention to provide an improved handle section combination for a billiard cue wherein each end of the strip can be tightly attached to the surface of the handle section without the disadvantage caused by humidity as well as hand perspiration of the user of the billiard cue.

It is another object of the present invention to provide a handle section combination for a billiard cue wherein the strip can evenly be wrapped about the whole surface of the handle section.

These and other objects and advantages of the present invention are achieved by providing an improved handle section combination for a billiard cue, which includes a handle section, an elongated strip and at least a binding ring. The handle section has an adjoining end to adjoin to the other section of the billiard cue. The strip is made of resilient materials and wrapped about the surface of the handle section. The strip has a front end with a first inserting portion. The binding ring is made of rigid materials and has at least one side with a first receiving portion. The binding ring is put around the adjoining end of the handle section in such a way that the first inserting portion of the strip can be received tightly in the first receiving portion of the binding ring when the strip is wrapped about the handle section.

DETAILED DESCRIPTION OF PREFERRED EMBODIMENTS

Figure 1:
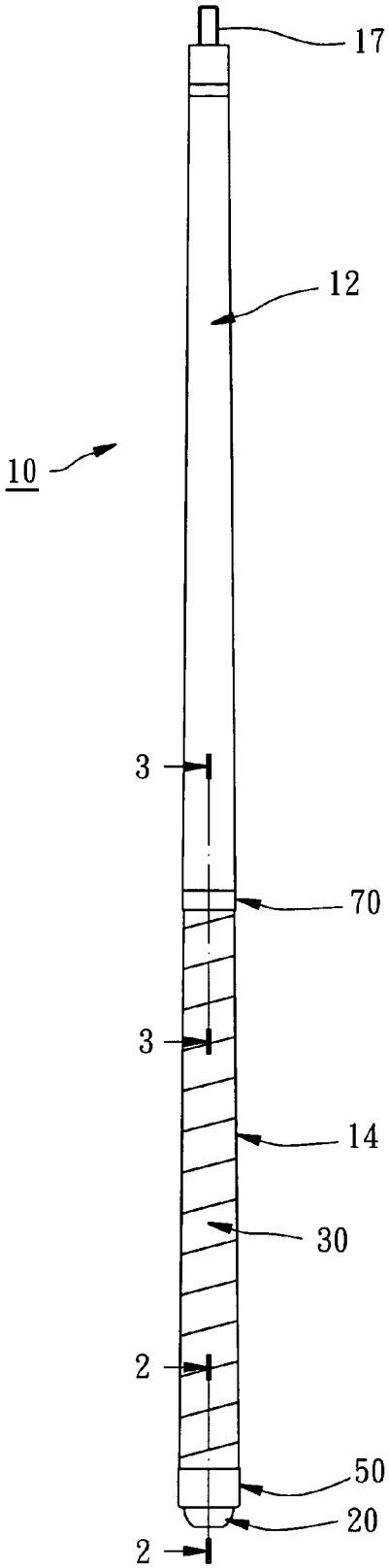
FIG. 1 is a perspective view of a handle section combination constructed according to a preferred embodiment of the present invention.
Figure 2:
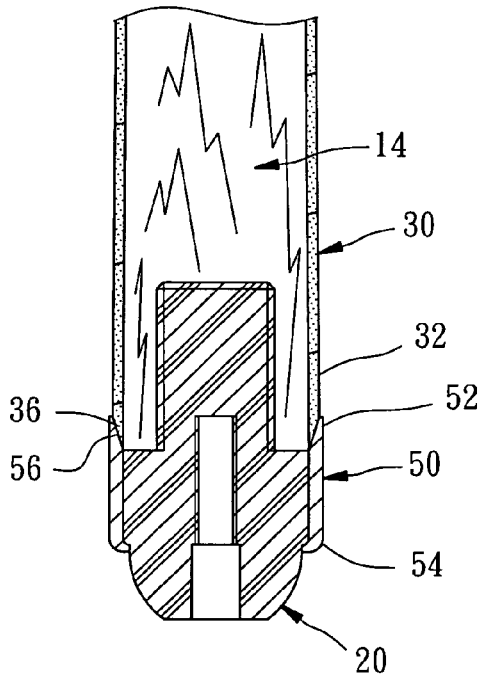
FIG. 2 is a cross-sectional view taken along the line 2—2 of FIG. 1.
Figure 3:
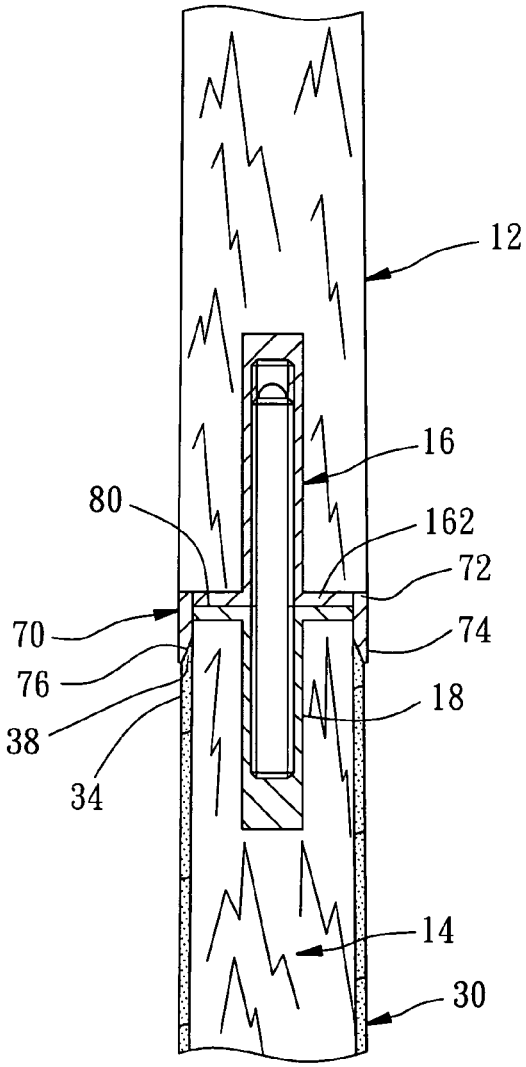
FIG. 3 is a cross-sectional view taken along the line 3—3 of FIG. 1.
Figure 4:
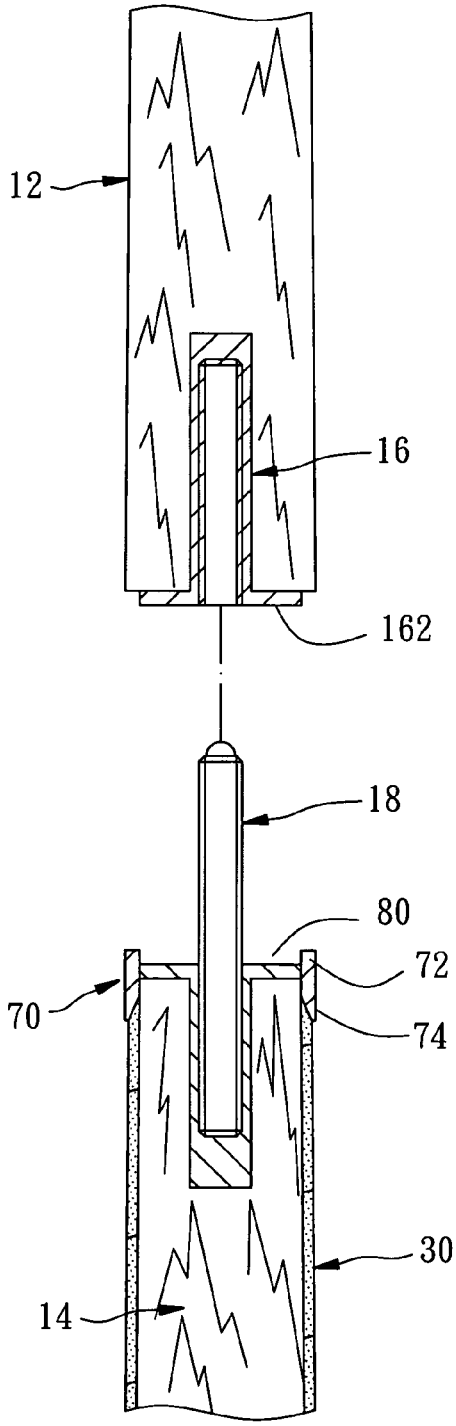
FIG. 4 is an exploded view of the structure shown in FIG. 3.

Referring now to the drawings, the handle section combination constructed according to a preferred embodiment of the present invention comprises a handle section 10 combined by a forward segment 12 and a backward segment 14, an elongated strip 30, a first binding ring 50 and a second binding ring 70.

The forward segment 12 has a bottom end provided a first female adjoining device 16 with a ringed protrude 162, and an upper end provided a first male adjoining device 17 to adjoin to the shaft section of a billiard cue (not shown in the drawings). The backward segment 14 has an upper end provided a second male adjoining device 18 to adjoin to the first female adjoining device 16 of the forward segment 12, and a bottom end attached with a butt cap 20.

The elongated strip 30 is made of resilient materials, such as leather or polyurethane. The strip 30 has a front end 32 with a first tapered portion 36 and a rear end 34 with a second tapered portion 38. The strip 30 is spirally wrapped about the surface of the backward portion 14 in such a way that the front end 32 is located on the bottom end of the backward segment 14, the rear end 34 is located on the upper end of the backward segment 14.

The first binding ring 50 is made of rigid materials, such as metal or fiber reinforced plastic. The binding ring 50 has an upper side 52 and a bottom side 54. The upper side 52 has a first tapered portion 56 matched with the first tapered portion 36 of the front end 32 of the strip 30.

The binding ring 50 is put around the bottom end of the backward segment 14 and the upper body of the butt cap 20 in such a way that the first tapered portion 36 of the strip 30 is received tightly in the first tapered portion 56 of the first binding ring 50 when the strip 30 is wrapped about the backward segment 14.

The second binding ring 70 is made of materials like the first binding ring 50. The binding ring 70 has an upper side 72 and a bottom side 74 with a second tapered portion 76 matched with the second tapered portion 38 of the rear end 34 of the strip 30.

The second binding ring 70 is put around the upper end of the backward segment 14 in such a way that the second tapered portion 38 of the strip 30 is received tightly in the second tapered portion 76 of the second binding ring 70 when the strip 30 is wrapped about the backward segment 14, and the upper side 72 of the second binding ring 70 is higher the upper end of the backward segment 14 to form a ringed recess 80 to receive the ringed protrude 162 of the female adjoining device 16 of the forward segment 12 when the backward segment 14 is adjoined with the forward segment 12.

As indicated above, when the strip is spirally wrapped about the surface of the handle section, each end of the strip is fixed by the binding ring so that the disadvantage caused by humidity as well as hand perspiration of the user of the billiard cue will be eliminated. Further, for having the special designs that the binding rings are put respectively around each end of the handle section and the ends of the strip are fixed by such rings, the strip can be evenly wrapped about the surface of the handle section.

What is claimed is:

1. A handle section combination for a billiard cue, comprising:

a forward segment having an upper end coupled with a first male adjoining device to connect to a shaft section of the billiard cue, and a bottom end coupled with a first female adjoining device;

a backward segment having an upper end coupled with a second male adjoining device to connect to said first female adjoining device of said forward segment, and a bottom end coupled with a butt cap;

an elongated strip made of resilient materials and having a front end with an first inserted portion and a rear end with a second inserted portion, said strip spirally wrapped about the surface of said backward segment;

a first binding ring made of rigid materials and having an upper side and a bottom side, said upper side having a first receiving portion, said first binding ring put around the upper end of said backward segment in such a way that said first inserted portion of said strip is received in said first receiving portion of said first binding ring; and a second binding ring made of rigid materials and having an upper side and a bottom side with a second receiving portion, said second binding ring put around the bottom end of said backward segment and said butt cap in such a way that said second inserted portion of said strip is received in said second receiving portion of said second ring.

2. The combination of claim 1, wherein said first inserted portion of said strip is a tapered portion.

3. The combination of claim 1, wherein said second inserted portion of said strip is a tapered portion.

4. The combination of claim 2, wherein said first receiving portion of said first binding ring is tapered to match with said first inserted portion of said strip.

5. The combination of claim 3, wherein said second receiving portion of said second ring is tapered to match with said second inserted portion of said strip.

6. The combination of claim 1, wherein said first female adjoining device of said forward segment has a ringed protrude, said first binding ring is put around said upper end of said backward segment in such a way that a side of said first ring is higher than said upper end of said backward segment to form a ringed recess for receiving said ringed protrude of said first female adjoining device of said forward segment.

* * * * *